US010443230B2

(12) United States Patent
Chamberlain et al.

(10) Patent No.: US 10,443,230 B2
(45) Date of Patent: Oct. 15, 2019

(54) COMPOSITE DECK FASTENER

(71) Applicant: BLACK & DECKER INC., New Britain, CT (US)

(72) Inventors: Matthew Chamberlain, Bethel, CT (US); Douglas Rose, Sherman, CT (US)

(73) Assignee: Black & Decker, Inc., Newark, DE (US)

( * ) Notice: Subject to any disclaimer, the term of this patent is extended or adjusted under 35 U.S.C. 154(b) by 311 days.

(21) Appl. No.: 15/428,763

(22) Filed: Feb. 9, 2017

(65) Prior Publication Data

US 2017/0226731 A1 Aug. 10, 2017

Related U.S. Application Data

(60) Provisional application No. 62/293,580, filed on Feb. 10, 2016.

(51) Int. Cl.
*E04B 1/41* (2006.01)
*E04B 1/00* (2006.01)

(52) U.S. Cl.
CPC ..... *E04B 1/4121* (2013.01); *E04B 1/003* (2013.01); *E04B 1/41* (2013.01)

(58) Field of Classification Search
CPC ..... E04B 1/0003; E04B 1/4121; E04B 1/41; F16B 15/00; F16B 19/14; Y10S 411/923
USPC ..... 411/487, 489, 490, 493, 923
See application file for complete search history.

(56) References Cited

U.S. PATENT DOCUMENTS 2,855,817 A * 10/1958 Kopf ..... B25C 1/18 411/441
2,999,571 A * 9/1961 Huber ..... F16B 19/14 227/9
3,505,919 A * 4/1970 Thurner ..... F16B 15/00 411/440
3,505,920 A * 4/1970 Thurner ..... F16B 19/14 29/432
3,978,759 A * 9/1976 Bakoledis ..... B25C 1/18 411/441
4,106,619 A * 8/1978 Haytayan ..... F16B 15/00 206/346
5,658,109 A * 8/1997 Van Allman ..... F16B 19/14 411/440
6,171,042 B1 * 1/2001 Olvera ..... F16B 15/00 411/441
6,851,906 B2 * 2/2005 Gassmann ..... F16B 15/00 411/440
7,040,851 B2 * 5/2006 Esser ..... F16B 15/00 411/451.1

(Continued)

*Primary Examiner* — Roberta S Delisle
(74) *Attorney, Agent, or Firm* — Rhonda L. Barton

(57) ABSTRACT

A direct fastening fastener particularly suited for use in normal weight or lightweight composite deck system. The fastener is heat treated to a dual-hardness level so that a portion of the fastener is capable of driving into the support member, such as a joist and a decking member. The remaining portion of the fastener remains relatively ductile so that it can withstand and transfer shear loads imposed by shifting of the concrete slab, which overlies the composite decking, to the support member. The fastener can be a single or multiple piece fastener which includes specially formed annular flanges that enhance interlocking between the fastener, the concrete slab and support members.

13 Claims, 8 Drawing Sheets

(56) References Cited

U.S. PATENT DOCUMENTS

| | | | | |
|---|---|---|---|---|
| 7,520,710 | B2 * | 4/2009 | Ortler | F16B 15/00<br>411/440 |
| 8,449,237 | B2 * | 5/2013 | Armiento | F16B 15/00<br>411/453 |

* cited by examiner

COMPOSITE DECK FASTENER

CROSS-REFERENCE TO RELATED APPLICATIONS

The present application claims priority under 35 U.S.C. § 119(e) to U.S. provisional patent application Ser. No. 62/293,580 entitled: Composite Decking Fastener filed Feb. 10, 2016, which is hereby incorporated by reference in their entirety.

BACKGROUND OF THE INVENTION

Field of the Invention

This invention relates generally to fasteners for securing composite decking to a steel supporting structure, and more particularly to a direct fastening fastener for use as a stud in lightweight or normal weight composite deck systems which are used as floors or roofs in modern buildings.

During construction of a composite deck, sheets of metal decking, which are often corrugated but can also be flat, are usually fastened to steel structural members. Located along and projecting upwardly from the steel members are metal studs. A concrete slab formed over the steel decking encases the metal studs, so that the studs restrict relative shear movement between the concrete slab and the steel member.

Description of the Related Art

Two general types of studs, namely, weld studs and self-drilling studs, are typically used to secure members in a composite deck. General weld studs are welded directly to the decking and/or steel structural members. These studs are ductile and so are suited to restrict the relative shear movement between the concrete slab and the steel decking. Installation of a weld stud requires that it burn through the decking in order to attach itself to the underlying steel support member. During the installation, the decking will burn away around the steel weld stud and will typically not attach itself to the support member. This would require a separate attachment operation to attach the deck to the support member.

Further, a round ceramic insulator is used at the end of the weld stud during the installation process. The round ceramic insulator is used to concentrate the heat and assist in welding of the stud to the steel support member. Once the weld stud is attached, the round ceramic insulator needs to be removed from the base of the weld stud, in order for the concrete to encase the stud. At this point, the typical way of removing the ceramic insulator is to strike the ceramic insulator with a hammer to break it away from the base of the installed weld studs. Since ceramic insulators are brittle, when broken away from the weld studs they shatter and scatter ceramic pieces over the deck surface. The scattered ceramic pieces must be removed from the deck surface prior to concrete pour, both for safety reasons and to avoid integration into the concrete mixture and contamination of the concrete integrity. Use of direct fastening fasteners does not require the above extra operations.

In the process of stud welding through the decking, the protective deck coating applied to the stud is damaged from the intense heat produced, rendering it susceptible to corrosion. A typical recommended practice is to apply the protective coating to the bare or damaged decking material to reduce corrosion effects. Use of direct fastening fasteners does not require the above extra operation.

Due to the nature of the weld joint between the stud and the steel, the diameter of the weld stud establishes a minimum material thickness that is required for the structural member. The smallest weld studs that are presently commercially used establish a lower limit on the material thickness of the structural member that can be used with those weld studs. The smallest diameter weld stud currently available is ½" diameter which requires a minimum of 0.200" thick steel. If the steel thickness is less than 0.200", which is usually encountered in a typical bar joist construction, the weld stud is not recommended. Direct fastening fasteners present an alternative in these applications.

Direct fastening fasteners or pins are thus an attractive alternative to weld studs for use in composite decks. Direct fastening fasteners do not limit the minimum material thickness of the structural member. In addition, direct fastening fasteners secure the decking to the steel, thereby eliminating the separate attachment needed with the use of weld studs. Direct fastening fasteners also avoid other problems with weld studs, such as the removal of the ceramic insulator from the stud after its installation, and the cleanup of ceramic pieces which are occasioned by the removal. The decking is not damaged, and indeed, the need to repair the metal decking and attach it to the stud or the metal support is eliminated. Use of a direct fastening fastener does not create a damaged area of the decking which must be repaired and instead, when properly installed provides a means for attaching the deck to the steel member. However, in order for the direct fastening fasteners to be capable of being fastened into the steel, the direct fastening fasteners must undergo a standard process of being heat treated to a relatively high degree of hardness. This standard processing results in the reduced ductility, and ductility is necessary in the direct fastening fastener to transfer the shearing movement in the composite deck system. Some fasteners have attempted to compensate for this basic deficiency by isolating the fastener from the concrete with a spacer. The spacer attempts to convert the shearing action of the concrete slab into a bending moment which the hardened fastener is more adept at resisting. However, it does not change the non-ductile nature of the direct fastening fasteners themselves.

SUMMARY OF THE INVENTION

The general aim of the present invention is to provide a direct fastening fastener for use in a composite deck system where the material cross-section of the steel member is less than the minimum material thickness required for a standard weld stud A more detailed objective is to achieve the foregoing by heat treating the fastener to a dual-hardness level so that a portion of the fastener is capable of driving into the steel while the remaining portion of the fastener is sufficiently ductile to transmit the shearing forces in a composite deck system to the main structural members.

An even more specific objective is to achieve the foregoing by heat treating an insertion member, of the fastener, to a relatively high degree of hardness while maintaining the remainder of the fastener in a relatively ductile condition.

Another general aim of the invention is to provide for enhanced interlocking between the fastener and the concrete slab in a composite deck system, whereby the concrete in the composite deck system is prevented from sliding off of the substrate or decking.

It is a feature of the invention that the fastener is provided with an integral flange which automatically establishes the height of the portion of the fastener that is encased in the concrete slab for proper concrete cover, which secures the decking to the steel, and which is shaped to transmit shearing loads.

A further feature is the provision of the fastener with a second integral flange which is located near the driving head of the fastener and which interacts with the concrete to limit deflection of the steel joists.

A further feature of the present invention is that the fastener can be driven from a powered fastening tool without deformation. As the fasteners of the present invention are able to withstand the forces of a powered driving tool, the construction of composite deck systems can be expedited thereby saving construction time.

In an embodiment, the fastener includes a striking unit including a driving head having a top surface capable of being stricken by a driving member and a bottom surface; an elongated shank along a longitudinal axis of the fastener, the elongated shank operatively connected to the striking unit and extending from the bottom surface of the striking unit; an insertion member integral with the elongated shank and disposed at an opposite end from the striking unit, the insertion member having a textured portion and a tip portion, and a first annular flange disposed between the elongated shank and the insertion member. At least a portion of the insertion member can be heat treated to enable the tip portion to drive into a decking member. The insertion member can be heat treated to a hardness greater than the hardness of the elongated shank and striking unit. In addition, the insertion member can be hardened to 54 minimum Rockwell C while the elongated shank and striking unit of the fastener are hardened to 50%-70% of the insertion member.

In an embodiment, the insertion member can have a rounded profile, a stepped profile or a straight profile. The insertion member can also have a textured or knurled portion having at least one of helix diamond pattern and a spiral pattern.

The striking unit can define a plurality of recesses along the length of the fastener and can be threadedly engaged with the elongated shank. The striking unit can also include a second annular flange on the striking unit, the second annular flange extending radially outward from the longitudinal axis of the fastener and having a diameter greater than the diameter of the driving head, the second annular flange and the driving head defining an annular recess therebetween In another embodiment, the fastener includes an elongated shank having an end portion with a top surface capable of being stricken by a driving member; an insertion member integral with the elongated shank at an opposite end from the end portion, the insertion member having a textured portion and a tip portion; an annular flange disposed between the insertion member and the end portion; and a threaded portion along the elongated shank adjacent to the end portion. At least a portion of the insertion member can be heat treated to enable the tip portion to drive into a decking member. The fastener can also include a nut threaded around the threaded portion of the elongated shank.

In another embodiment, the fastener can include an elongated shank with a longitudinal axis, a first end, and a second end; a striking unit positioned at the first end; an insertion member positioned at the second end, the insertion member including a tip portion; at least one annular flange formed on the elongated shank and extending radially outward; and at least one ridge formed on the insertion member and defining a helix around the longitudinal axis. At least a portion of the tip can be heat treated and textured to enable the tip portion to drive into a decking member.

These and other objects and advantages of the invention will become more apparent from the following detailed description when taken in conjunction with the accompanying drawings.

Figure 1:
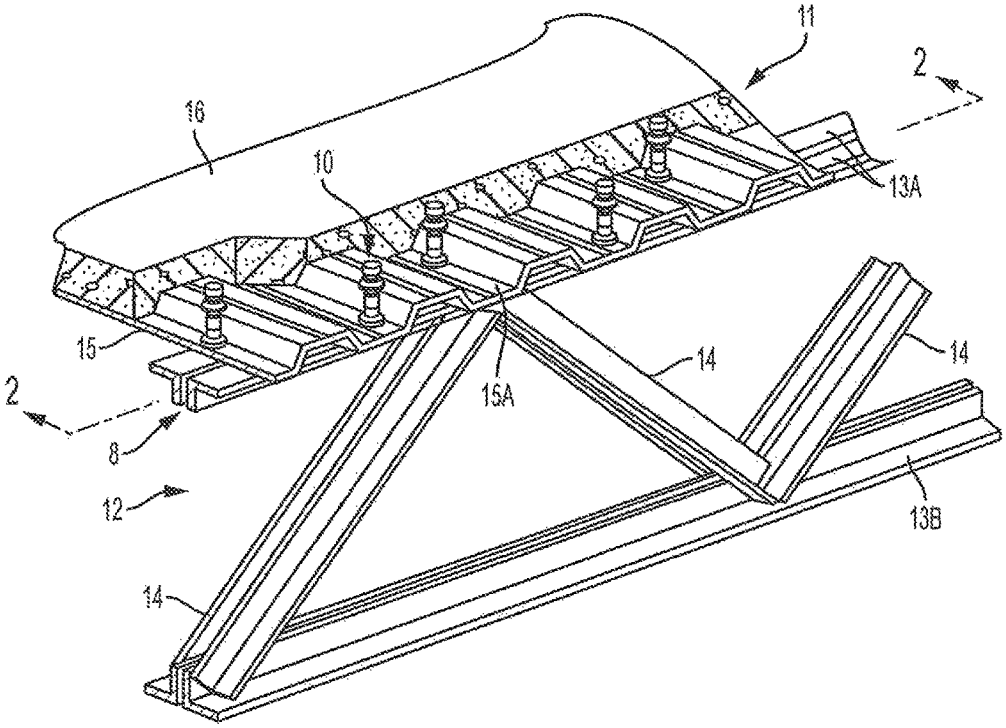
FIG. 1 is a fragmentary perspective view of a typical composite deck structure using new direct fastening fasteners incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring to FIG. 1, for purposes of illustration, the present invention is shown in the drawings as embodied in a direct fastening pin or fastener 10. A direct fastening fastener is a fastener that can be driven from a powered fastener driving tool, such as the driving tool 2, shown in FIGS. 7A and 7B. The direct fastening fastener (herein "fastener") 10 is especially useful as a fastener in deck systems that are used as floors or roof decks in modern buildings. A floor or roof deck is subject to shear forces that tend to cause a horizontal, or shearing movement of the deck relative to its support structure. The fastener 10 of the present invention restricts and transfers this shearing movement when used in a composite deck system.

Figure 2:
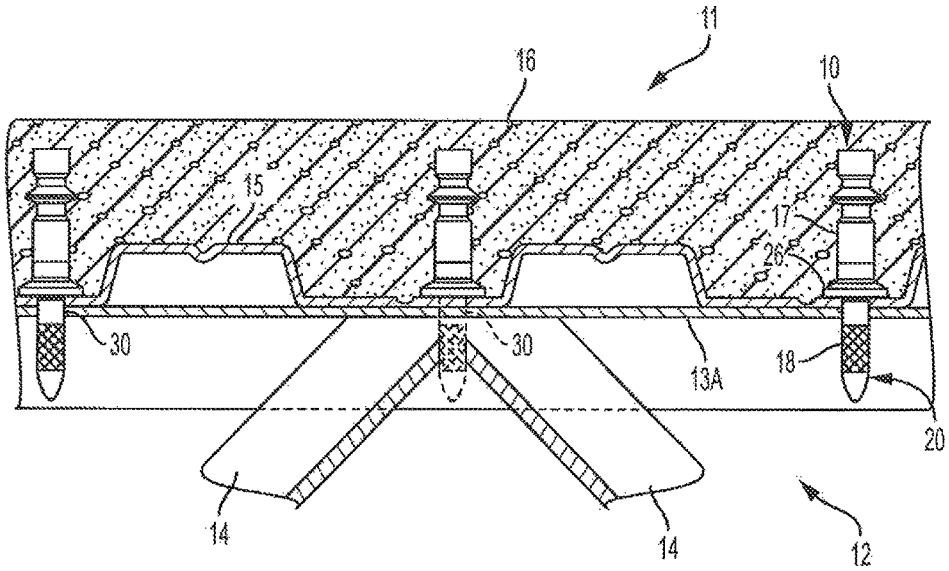
FIG. 2 is an enlarged fragmentary cross-sectional view taken substantially along the line 2-2 of FIG. 1.

A composite deck system, such as in composite deck system 11, is typically fabricated at a building site by joining primary structural members to secondary structural members. In an embodiment, primary structural members 8 can be metal and include a decking member 15 and a support member, namely an upper elongated horizontal joist member 13A. The fastener 10 is driven through the primary structural members 8 as shown in FIGS. 1 and 2. Secondary structural members 12 can also be metal and include a lower elongated horizontal joist member 13B and a web member 14. The structural members 8 and 12 include joist members or beams, but not are restricted to these members. During construction of a building, the secondary structural members 12 are joined to the building structural support beams (not shown). The primary structural members 8 are then joined to the secondary structural members 12. Joist members, such as steel joists, are typically comprised of vertically spaced upper and lower elongated horizontal joist members 13A and 13B, and supporting web members 14 joined to and extending between the horizontal joist members. In light-weight composite deck systems, the joist members are formed with material cords having a relatively thin cross-section (e.g., less than 0.200").

The decking member 15, such as, for example, the metal decking shown in FIG. 1, is typically laid over and spans adjacent joist members 13A so that corrugations, if present, run at a right angle to the joists. In an embodiment, the composite deck system may be fabricated without a corrugated decking member. FIGS. 1 and 2 illustrate corrugations 15A that form peaks and valleys along the length of the decking member 15. Located in and projecting upwardly from the upper horizontal joist members 13A and through the decking member 15 are the fasteners 10. A concrete slab 16 is then poured over the decking member 15, encasing the upper portion of the fasteners 10.

Figure 3:
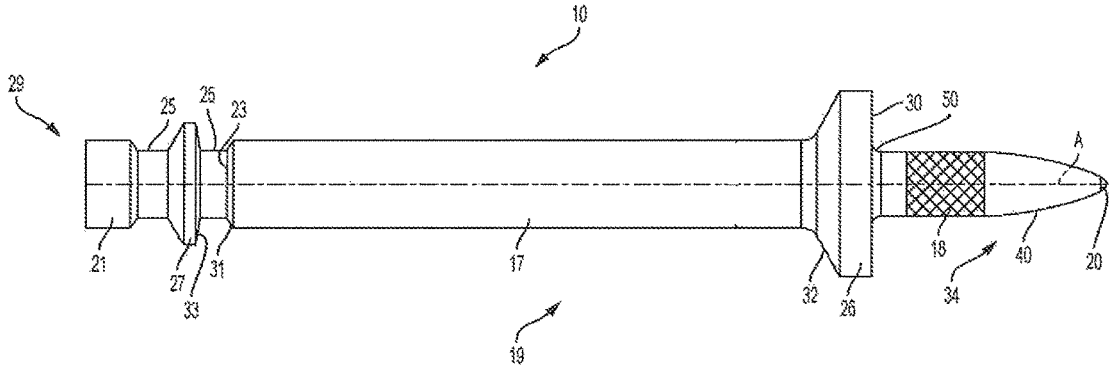
FIG. 3 is an enlarged side view of the fastener shown in FIGS. 1 and 2.
Figure 4A:
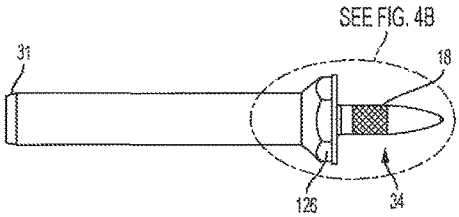
FIG. 4A is an exemplary view of the fastener according to a second embodiment of the invention.
Figure 4B:
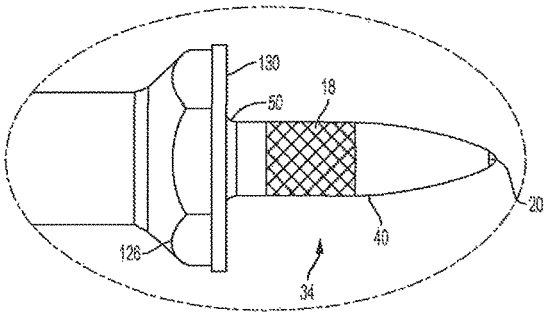
FIG. 4B is an enlarged view of an area of the fastener that is heat treated to a relatively high degree of hardness.

As illustrated, for example, in FIG. 3, the fastener 10 has an elongated shank 17 having a longitudinal axis A. The elongated shank 17 has an upper shank portion 19 and a lower shank portion or insertion member 34. The insertion member 34 has a diameter that is smaller than the diameter of the upper shank portion 19 and includes a tapered portion 40 and a knurled portion 18. The knurled portion 18 has a series of ridges and/or indentations. The knurl causes a welding effect between the fastener and the steel joist when the fastener is engaged in the joist. The knurled portion 18 can include, for example, a helix diamond knurl pattern as shown in FIGS. 3-4B. The upper shank portion 19 is an unknurled portion of the shank 17. Alternative knurled patterns include a spiral pattern 118 as shown in FIGS. 5A-6B. The spiral patterned knurl 118 introduces rotation during the driving of the fastener as disclosed in U.S. Pat. No. 8,449,237, which is incorporated by reference in its entirety.

Figure 5A:
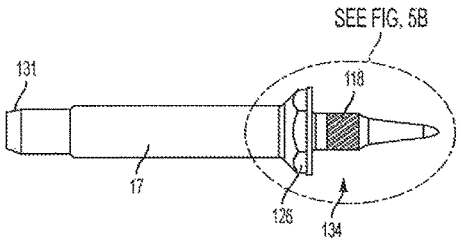
FIG. 5A is an exemplary view of the fastener according to a third embodiment of the invention.
Figure 5B:
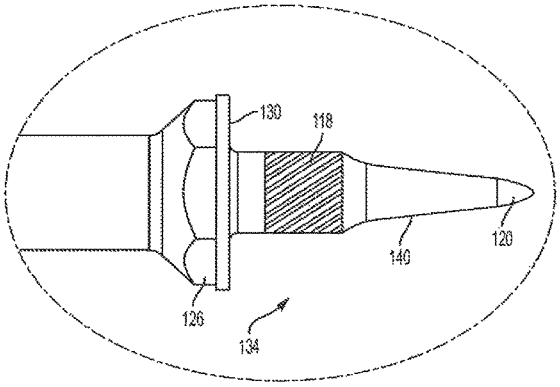
FIG. 5B is an enlarged view of an area of the fastener that is heat treated to a relatively high degree of hardness.
Figure 6A:
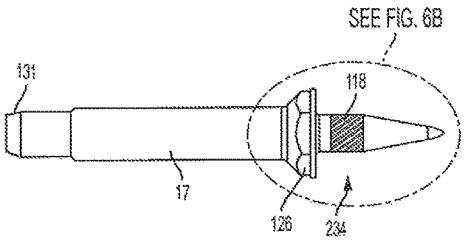
FIG. 6A is an exemplary view of the fastener according to a fourth embodiment of the invention.
Figure 6B:
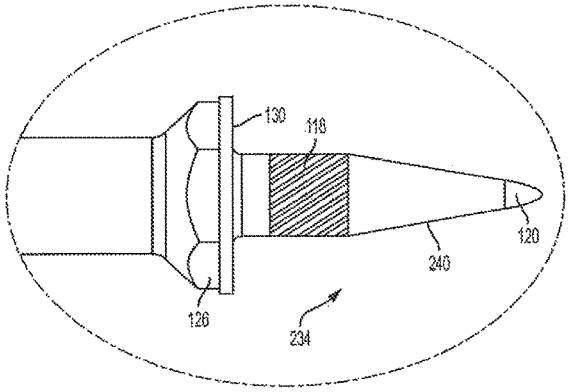
FIG. 6B is an enlarged view of an area of the fastener that is heat treated to a relatively high degree of hardness.

Projecting from one end of the tapered portion 40 is a pointed tip 20 configured for driving into the decking member 15 and upper joist members 13A. The tapering of the insertion member 34, slows the fastener during the driving action into the joist members to eliminate over driving. The tapered portion 40 of the insertion member 34 is illustrated as having a rounded profile, as shown in FIGS. 3-4B. An alternative insertion member 134 embodied by the present invention as shown in FIGS. 5A-5B, has a stepped tapered portion 140. Another alternative insertion member 234 embodied by the present invention as shown in FIGS. 6A-6B has a straight tapered portion 240. In an embodiment, the stepped tapered portion 140, and straight shank 240 can have a sharper pointed tip 120 than the pointed tip 20 of the rounded tapered portion, of FIGS. 3-4B. Additionally, the sharper point of the stepped 140 and straight 240 tapered portions allows penetration through thicker steel bodies.

Figure 9:
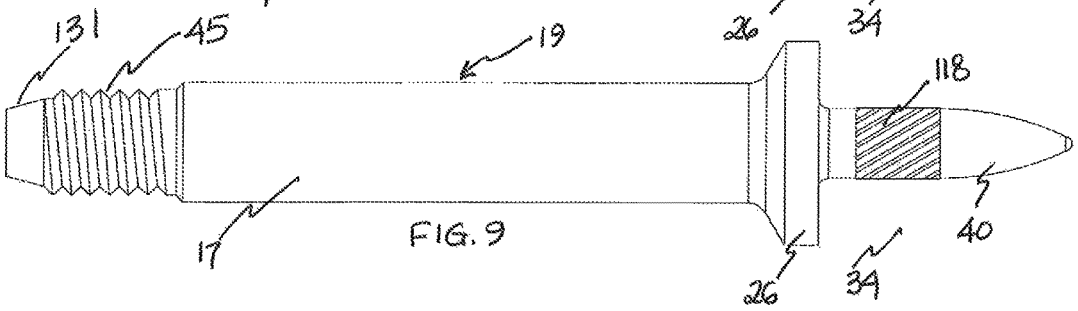
FIG. 9 is an exemplary view of the fastener according to a sixth embodiment of the present invention.
Figure 10:
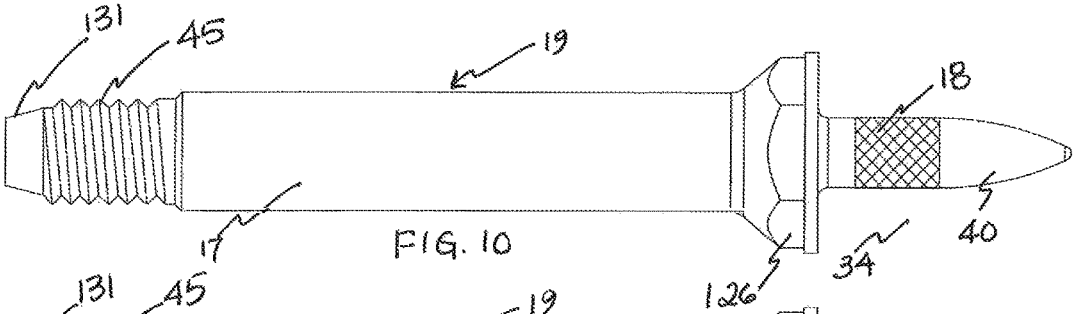
FIG. 10 is an exemplary view of the fastener according to a seventh embodiment of the present invention.
Figure 11:
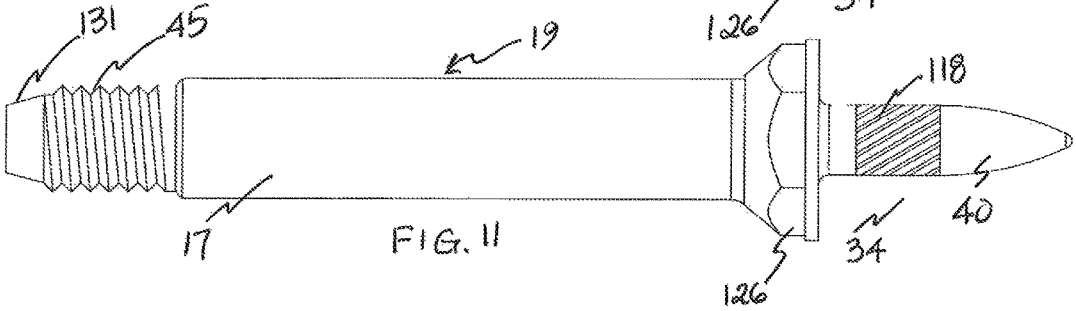
FIG. 11 is an exemplary view of the fastener according to an eighth embodiment of the present invention.

Embodiments of the present invention include any combination of the above knurled portions and tapered portions. For example, in an embodiment, a fastener 10 can include the rounded tapered portion 40 with a spiral pattern knurled pattern as shown in FIGS. 9 and 11.

Located at the end of the fastener 10 opposite the pointed tip 20 is a driving head 21. The driving head 21 is formed to engage the driving member 4 of the driving tool 2 which is capable of striking the top surface of the driving head end of the fastener. In an embodiment as shown in FIGS. 3 and 4A, 5A and 6A, the fastener 10 can be stricken at the end portion 31 of the shank 17, which has a chamfered driving head 23. The driving member 4 can be a driven by any of the many other well-known axial driving means. As shown in FIG. 2, the driving tool 2 drives the pointed tip 20 and knurled portion 18 of the fastener through the decking member 15, into the valleys of the corrugations 15A and through the upper horizontal joist members 13A.

An integral annular lower flange 26 is located between the insertion member 34 and the upper shank portion 19 of the fastener 10. The lower flange 26 has a diameter that is greater than the diameter of the shank 17 thereby providing a bearing surface 30 that contacts the joist members 13A and prevents over-driving or distortion of the joists.

In accordance with the present invention, the fastener 10 is selectively heat treated to a dual-hardness level so that the insertion member 34 has a relatively high degree of hardness to enable it to drive into the decking member 15 and the upper horizontal joist members 13A. The upper shank portion 19 of the fastener 10 is also heat treated, but to a lesser degree of hardness so that it remains relatively ductile and capable of resisting and transmitting the shearing forces of the concrete slab 16 in which it is encased. The shearing forces of the concrete slab 16 are generally directed left or right, relative to the decking member 15 and upper horizontal joist members 13A. In addition, the fastener 10 is uniquely constructed so that it correctly positions itself in and enhances interlocking with the concrete slab 16, in addition to establishing correct concrete slab cover.

During construction of the composite deck system 11, the insertion members 34 are driven through the valleys of the decking member 15 and through the upper horizontal joist members 13A. When each fastener 10 is driven, the bearing surface 30 of the lower flange 26 engages the decking member 15, thereby fastening the decking to the underlying joist members 13A. The lower flange 26 provides positive localized fastening. In particular, the lower flange 26 provides a positive stop to the fastener when the fastener is driven into the decking member 15 and the bearing surface 30 engages the decking member 15. As a result, the lower flange 26 ensures that the height of each fastener with respect to the horizontal joist member 13A is consistent, for uniform concrete cover requirements of the concrete slab 16 above the fastener. In addition, the lower flange 26 adds stability to the driven fastener within the concrete slab 16.

The bearing surface 30 of the lower flange 26 is substantially flat and joins the knurled shank portion 18 at chamfered surface or radiused angle 50. The radiused angle 50 increases the strength of the fastener in the area in contrast to sharp angles that can fracture when a heat treated fastener is driven by a powered driving tool. When the fastener is driven into place as shown in FIG. 2, the bearing surface 30 will securely fasten the top side of the decking to the underlying joist members 13A.

Additionally, the upper side of the lower annular flange 26 is smoothly radiused as at 32 to flare slowly from the angular flange to the upstanding shank 17. It is found that the curved or radiused junction is important to prevent cracking of the fastener when subjected to bending loads. The curved shape may also tend to distribute the shear forces, particularly when the concrete slab itself has a significant component loading the flange against the corrugated decking and joist members.

FIG. 3 illustrates a second or upper annular flange 27 located directly below the driving head 21, between the driving head and the upper shank portion 19 of the shank 17. The upper flange 27 is smaller in diameter than lower flange 26. The driving head 21 and upper flange 27 form a striking unit 29. The striking unit 29 has a profile that includes recesses 25 that define concrete interlocking areas, where the concrete is wedged between the driving head 21, flange 27 and end portion 31 of the shank 17. The recesses 25 allow concrete to form around the upper flange 27 and between sections of the striking unit, thereby creating an interlocking relationship between the fastener 10 and the concrete slab 16.

In an embodiment, the striking unit 29 can be integral with the upper shank portion 19 of the shank 17. In another embodiment, the striking unit 29 can be separate from the upper shank portion 19 of the shank 17 and attached thereto by external threads that threadedly engage internal threads on the inner surface of the upper shank portion 19. In further embodiment, the striking unit 29 can be separate from the upper shank portion 19 of the shank 17 and attached thereto by internal threads that threadedly engage external threads on the outer surface of the upper shank portion, similar to a post nut.

In an embodiment in which the striking unit 29 is separate from the shank 17, the striking unit can be attached to the shank before or after the fastener is driven into the decking member 15 by the driving tool 2. If the striking unit 29 is attached to the shank 17 after the fastener 10 is driven into the metal decking member 15, then the end portion 31 of the shank can be struck by the driving member 4 of the driving tool 2. In this regard, the end portion 31 of the shank 17 has a chamfered end 23 to prevent the end portion from becoming deformed when the fastener 10 is struck by the driving member 4. The chamfered portion 23 also helps the fastener 10 maintain its shape and not deform in embodiments where the striking unit 29 is integral with the shank portion 17 of the fastener.

When a shearing force acts on the upper portion of the fastener 10 that is encased in the concrete slab 16 (FIG. 2), the upper shank portion 19 of the fastener tends to bend, in a cantilever fashion, about the center of the lower flange 26, thereby pivoting the driving head 21 and the upper flange 27. As the upper flange 27 and the driving head 21 try to pivot in the concrete, the concrete surrounding the upper flange and the driving head responds with a restoring force couple. This restoring force couple is applied to the bottom surface 33 of the upper flange 27 opposite the shearing force and to the upper side of the upper flange 27 and driving head on the side of the shearing force. As a result, deflection of the fastener 10 in response to the shearing force is reduced. In this manner, the upper flange 27 enhances the structural interlocking between the fastener and the concrete slab. This same restoring force couple also has the effect of creating an upwardly directed force on the fastener at the underside of the upper flange 27, which tends to act through the insertion member 34 to reduce the deflection of the joist members 13A and web 14.

In carrying out the invention, the fastener 10 is heat treated to a dual-hardness level with a Drill-Flex® heat treating process developed by Elco Industries, Inc., Rockford, Ill. Specifically, the insertion member 34, 13, 234 is heat treated to a relatively high hardness so that it is capable of effectively tapping into the decking member 15 and the upper horizontal joist member 13A. The remaining portions of the fastener, i.e., the driving head 21, the upper shank portion 19, and the annular flanges 26 and 27, are heat treated to a lesser degree of hardness so that they remain relatively ductile and capable of resisting and transmitting the shearing forces of the floor or roof secondary structural members 12 to the main structural supports without failure. By way of example, the insertion member 34 is hardened to 54 minimum Rockwell C while the remaining portion of the fastener is hardened to 50%-70% of the insertion member 34.

As shown in FIGS. 5A-6B, 9 and 11, the flange can be in the form of a hex member 126 having a bearing surface 130. The hex shape allows for additional tightening of the fastener into the primary structural members 8.

Additionally, in further embodiments as shown in FIGS. 8, 9, 10 and 11, one end of the elongated shank 17 can have an externally threaded portion 45 that can threadedly engage internal threads on a post nut or cap (not shown). The post nut can have a diameter that is larger than the diameter of the threaded portion 45, thereby creating a recess between the post nut and the threaded portion. As with the striking unit 29, the recesses allow concrete to form around the post nut thereby creating an interlocking relationship between the fastener 10 and the concrete slab 16.

Figure 7A:
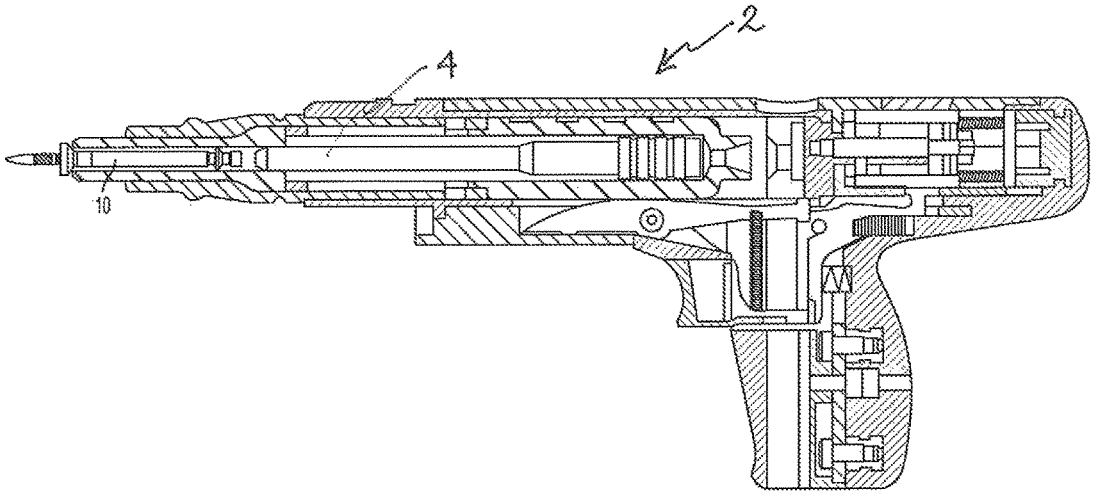
FIGS. 7A and 7B illustrate a cross-sectional view of an embodiment of a driving tool for driving the fastener into the composite deck structure.
Figure 7B:
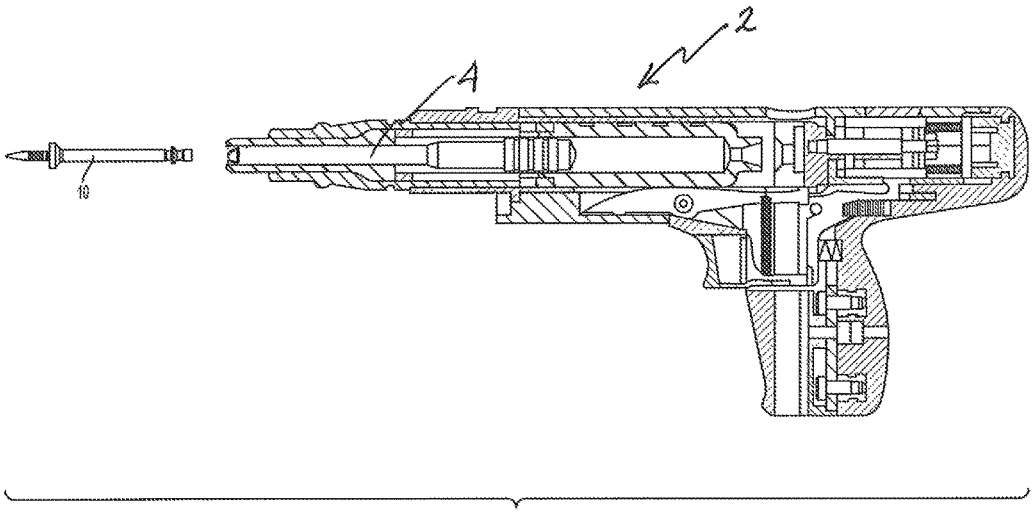
Figure 8:
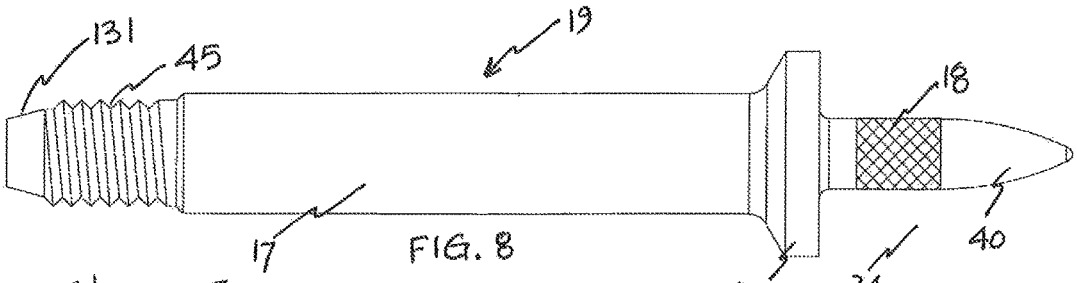
FIG. 8 is an exemplary view of the fastener according to a fifth embodiment of the present invention.

The driving tool can include, but is not limited to pneumatic tools, air powered tools, cordless battery-powered tools, nitrocellulose technology systems and gas fastening delivery systems. Further, a driving tool can include a powder actuated tool as shown in FIGS. 7A and 7B, which illustrate a configuration of the driving tool 2 with the fastener 10 within the tool body and after the fastener is driven from the tool.

From the foregoing, it will be apparent that the present invention brings to the art a new and improved fastener 10 for use in a lightweight or normal weight composite deck system 11 where the use of standard weld studs is precluded. In addition, the ability of the fastener 10 to resist and transfer shear forces in a composite deck system is enhanced over prior weld studs and many self-drilling studs by virtue of the dual-hardness levels embodied in the fastener and the provisions of the integral upper flange 27 which enhances interlocking between the fastener 10 and the concrete slab 16 and primary 8 structural members. Additionally, the installation of the powered fastener 10 is faster and therefore time-saving over the installation of weld studs.

While aspects of the present invention are described herein and illustrated in the accompanying drawings in the context of a fastener and tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

We claim:

1. A fastener comprising:

a striking unit including a driving head having a top surface capable of being stricken by a driving member and a bottom surface;

an elongated shank along a longitudinal axis of the fastener, the elongated shank operatively connected to the striking unit and extending from the bottom surface of the striking unit;

an insertion member integral with the elongated shank and disposed at an opposite end from the striking unit, the insertion member having a textured portion and a tip portion, and a first annular flange disposed in fixed relation between the elongated shank and the insertion member during striking by the driving member, wherein at least a portion of the insertion member is heat treated to enable the tip portion to drive into a decking member, and wherein further comprising a second annular flange on the striking unit, the second annular flange extending radially outward from the longitudinal axis of the fastener and having a diameter greater than the diameter of the driving head, the second annular flange and the driving head defining an annular recess therebetween.

2. The fastener according to claim 1, wherein the insertion member is heat treated to a hardness greater than the hardness of the elongated shank and striking unit.

3. The fastener according to claim 1, wherein the insertion member is hardened to 54 minimum Rockwell C while the elongated shank and striking unit of the fastener are hardened to 50%-70% of the insertion member.

4. The fastener according to claim 1, wherein the insertion member comprises a rounded profile.

5. The fastener according to claim 1, wherein the insertion member comprises one of a stepped profile and a straight profile.

6. The fastener according to claim 1, wherein the striking unit comprises a plurality of recesses.

7. The fastener according to claim 1, wherein the striking unit is threadedly engaged with the elongated shank.

8. The fastener according to claim 1, wherein the insertion member comprises a textured portion.

9. The fastener according to claim 8, wherein the textured portion comprises a knurled portion.

10. The fastener according to claim 9, wherein the knurled portion comprises one of a helix diamond pattern and a spiral pattern.

11. A fastener comprising:

an elongated shank having an end portion with a top surface capable of being stricken by a driving member;

an insertion member integral with the elongated shank at an opposite end from the end portion, the insertion member having a textured portion and a tip portion;

an annular flange disposed in a fixed position between the insertion member and the end portion during striking by the driving member; and a threaded portion along the elongated shank adjacent to the end portion, wherein at least a portion of the insertion member is heat treated to enable the tip portion to drive into a decking member.

12. The fastener according to claim 11, further comprising a nut threaded around the threaded portion of the elongated shank.

13. A fastener, comprising:

an elongated shank with a longitudinal axis, a first end, and a second end;

a striking unit positioned at the first end;

an insertion member positioned at the second end, the insertion member including a tip portion;

at least one annular flange formed on the elongated shank at a fixed distance from the insertion member, and extending radially outward therefrom; and at least one ridge formed on the insertion member and defining a helix around the longitudinal axis, wherein at least a portion of the tip is heat treated and textured to enable the tip portion to drive into a decking member, and wherein further comprising a second annular flange on the striking unit, the second annular flange extending radially outward from the longitudinal axis of the fastener and having a diameter greater than the diameter of the driving head, the second annular flange and the driving head defining an annular recess therebetween.

* * * * *